US011231174B2

(12) United States Patent
Schmiederer et al.

(10) Patent No.: US 11,231,174 B2
(45) Date of Patent: Jan. 25, 2022

(54) DETECTING BLOCKAGE OF A DUCT OF A BURNER ASSEMBLY

(71) Applicant: Siemens Aktiengesellschaft, Munich (DE)

(72) Inventors: Bernd Schmiederer, Karlsruhe (DE); Holger Holfelder, Gaggenau (DE); Rainer Lochschmied, Rheinstetten-Forchheim (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 544 days.

(21) Appl. No.: 15/934,186

(22) Filed: Mar. 23, 2018

(65) Prior Publication Data

US 2018/0274782 A1 Sep. 27, 2018

(30) Foreign Application Priority Data

Mar. 27, 2017 (EP) ..... 17163123

(51) Int. Cl.
*F23N 5/18* (2006.01)
*F23N 5/24* (2006.01)
(Continued)

(52) U.S. Cl.
CPC ..... *F23N 5/18* (2013.01); *F23N 1/022* (2013.01); *F23N 5/003* (2013.01); *F23N 5/123* (2013.01);
(Continued)

(58) Field of Classification Search
CPC ... F23N 5/00; F23N 5/003; F23N 5/12; F23N 5/123; F23N 5/126; F23N 5/18;
(Continued)

(56) References Cited

U.S. PATENT DOCUMENTS 4,703,306 A * 10/1987 Barritt ..... G01R 31/2825 340/12.33
5,632,614 A * 5/1997 Consadori ..... F23N 5/20 431/79
(Continued)

FOREIGN PATENT DOCUMENTS

EP 0770824 A2 5/1997 ..... F23N 1/02
EP 0806610 B1 7/2001 ..... F23N 1/02
(Continued)

*Primary Examiner* — Frantz F Jules
*Assistant Examiner* — Daniel C Comings
(74) *Attorney, Agent, or Firm* — Slayden Grubert Beard PLLC

(57) ABSTRACT

The present disclosure deals with the detection of a blockage in the air-supply duct or flue of a burner assembly. In some embodiments, a method or system may detect blockages in the form of coverings and with burner assemblies to burn fossil fuels. For example, a control device may generate: a first air-control signal; a fuel-control signal by adjusting the actual values of the ionization current to the ionization-current setpoint; a setpoint increased by a specified amount from the ionization-current setpoint; and a changed fuel-control signal by adjusting the actual values of the ionization current to the increased setpoint in the case of a first air-control signal. The control device may evaluate the changed fuel-control signal generated based on the increased setpoint by comparing it with a specified maximum value and based on the evaluation, to detect a blockage. The control device may recognize the blockage based on the evaluation if the fuel-control signal generated using the increased setpoint exceeds the specified maximum value.

14 Claims, 7 Drawing Sheets

(51) Int. Cl.

| | |
|---|---|
| ***F23N 5/12*** | (2006.01) |
| ***F23N 5/00*** | (2006.01) |
| ***F23N 5/26*** | (2006.01) |
| ***F23N 1/02*** | (2006.01) |

(52) U.S. Cl.
CPC ..... *F23N 5/242* (2013.01); *F23N 5/265* (2013.01); *F23D 2208/00* (2013.01); *F23J 2211/101* (2013.01); *F23J 2213/70* (2013.01); *F23N 2005/185* (2013.01); *F23N 2225/30* (2020.01); *F23N 2233/08* (2020.01); *F23N 2900/05001* (2013.01); *F23N 2900/05005* (2013.01)

(58) Field of Classification Search
CPC ..... F23N 5/24; F23N 5/242; F23N 2005/181; F23N 2005/184; F23N 5/265; F23N 5/2005; F23N 5/185; F23N 2900/05001; F23N 2900/05005; F23J 2213/70; F23D 2208/00; F24H 9/2042
See application file for complete search history.

(56) References Cited

U.S. PATENT DOCUMENTS

| | | | | |
|---|---|---|---|---|
| 5,899,683 | A * | 5/1999 | Nolte | F23N 5/123 431/25 |
| 5,924,859 | A | 7/1999 | Nolte et al. | 431/12 |
| 6,676,404 | B2 | 1/2004 | Lochschmied | 431/75 |
| 7,090,486 | B2 | 8/2006 | Lochschmied | 431/25 |
| 7,255,285 | B2 * | 8/2007 | Troost | F23N 5/242 236/91 B |
| 2012/0156628 | A1 | 6/2012 | Lochschmied et al. | 431/78 |
| 2016/0209026 | A1 | 7/2016 | Born et al. | 431/2 |
| 2017/0038068 | A1 * | 2/2017 | Yang | F23N 5/245 |

FOREIGN PATENT DOCUMENTS

| | | | | |
|---|---|---|---|---|
| EP | 1293727 | A1 | 3/2003 | F23N 1/02 |
| EP | 1154203 | B1 | 8/2006 | F23N 5/12 |
| EP | 1701096 | A1 | 9/2006 | F04D 27/02 |
| EP | 1750058 | A2 | 2/2007 | F23N 5/12 |
| EP | 2466204 | A1 | 6/2012 | F23N 5/12 |
| EP | 3045816 | A1 | 7/2016 | F23N 5/12 |
| GB | 2286038 | A | 8/1995 | F23N 5/12 |

* cited by examiner

DETECTING BLOCKAGE OF A DUCT OF A BURNER ASSEMBLY

CROSS-REFERENCE TO RELATED APPLICATIONS

This application claims priority to EP Application No. 17163123.7 filed Mar. 27, 2017, the contents of which are hereby incorporated by reference in their entirety.

TECHNICAL FIELD

The present disclosure deals with the detection of a blockage in the air-supply duct or flue of a burner assembly. In some embodiments, a method or system may detect blockages in the form of coverings and with burner assemblies to burn fossil fuels.

BACKGROUND

In burner assemblies, the air-ratio increment can be detected and/or adjusted during combustion based on an ionization current generated at an ionization electrode. An alternating voltage is initially applied to the ionization electrode. Due to the rectifier effect of a flame, an ionization current only flows in a single direction as a direct current.

The setpoint for the ionization current detected at the ionization electrode is applied over the speed of the fan of a gas burner in a control setpoint curve. The ionization current is typically measured in microamperes. The speed of the fan of a gas burner is typically measured in revolutions per minute. The speed of the fan of a gas burner is a measure for the volumetric air flow and the power of the burner assembly at the same time, meaning a heat quantity over a certain period of time.

If the air-supply duct/flue is covered and/or blocked, this results in a significant reduction of the volumetric air flow. Thereby, the rotational speed detection system does not detect the change of volumetric flow due to the air-supply duct/flue change. If there is no further indicator for the volumetric air flow available, the setpoint of the ionization current is therefore not adapted due to the functional relationship between the ionization-current setpoint and the fan speed. An adjustment is carried out using a false ionization-current setpoint value with regard to the actual volumetric air flow.

In particular, in the case of medium- and small-scale burner output power levels, typically, a shift to smaller values of the air-ratio increment $\lambda$ takes place due to this. The reason for this lies in the form of the ionization-current characteristic curve over the speed. In the case of greater changes of the air-supply duct/flue, strong coverings and/or blockages can result in increased CO levels in borderline cases. In addition to covering the air-supply duct/flue, there are other conditions that can result in a comparable situation. Among other things, this includes exhaust gas in the air supply due to defective exhaust-gas recirculation.

Furthermore, similar to how, by means of covering the air-supply duct/flue, a drift of the ionization signal adjusts the air-ratio increment $\lambda$ in such a way that $\lambda$ moves close to $\lambda=1$. Even then, critical combustion with increased CO levels can occur. Bending the ionization electrode and/or the formation of deposits and/or damage to the ionization electrode can cause the drift to occur. Tests that correct this drift must usually be performed at certain fixed speed points. If these points are not reached, because, for example, the heat cannot be dissipated, the burner assembly would have to be shut down and/or be locked. This is because without shutting it down and/or locking it, it is not guaranteed that no critical emissions occur.

The European patent application EP3045816A1, Device for the control of a burner assembly, was registered on Jan. 19, 2015 and published on Jul. 20, 2016. EP3045816A1 discloses and claims a device for the controlling a burner assembly, which allows the estimation of ionization current even if a measurement of the same fails. To do this, an estimation of the ionization current is carried out for a volumetric air flow, which is part of a burner power output, for which no measurement was possible under certain circumstances.

The European patent EP2466204B1 was registered on Dec. 16, 2010 and granted on Nov. 13, 2013. EP2466204B1 discloses and claims a control device for a burner assembly. Thereby, a control device performs a test method in a plurality of steps. In a second step, the actuators of a burner assembly are guided to a supply ratio, which is one air-ratio increment above the stoichiometric value, $\lambda=1$.

The European patent EP1293727B1, Control apparatus for a burner and a method for adjustment, was granted on Nov. 23, 2005. EP1293727B1 describes how to increase the ionization-current setpoint in a closed control circuit. In response, the change of the gas-valve setting or an equivalent is measured, for example, the change of a shear parameter. With the method described in EP1293727B1, a change of the covering can be detected. However, this method can only be used at defined burner power-output points due to defined reference points and due to the stability of the ionization signal. Furthermore, the manufacturing tolerances of the valves considerably influence the result. By means of this, the applicability of the method described there is limited.

The European patent application EP0806610A2, Method and device for operating a gas burner, was registered on Apr. 9, 1997 and published on Nov. 12, 1997. EP0806610A2 deals with shutting down a gas burner if an ionization signal exceeds a permissible control range for longer than a specified time duration. Thereby, the permissible control range comprises an upper maximum value of the ionization signal and a lower limit value. The lower limit value lies over a limit value where the combustion no longer has a low emission level.

The European patent application EP0770824A2, Method and circuit for controlling a gas burner, was registered on Oct. 1, 1996 and published on May 2, 1997. According to the method disclosed in EP0770824A2, an ionization signal is measured and its maximum value is saved. An electrical setpoint of a control circuit is adjusted with that maximum value. The objective is that control circuit adjusts to the same Lambda setpoint.

SUMMARY

The teachings of the present disclosure may be embodied in a method and/or a controller to detect blockages in the air-supply duct and/or the flue, whereby the aforementioned disadvantages are at least partially overcome. For example, a control device to control a combustion carried out by a burner assembly depending on an ionization-current setpoint may comprise a flame area (2) and at least one ionization electrode (7) arranged within a flame area (2) of the burner assembly and an air-control element (3), which is designed to influence a supply volume of air depending on an air-control signal (11), and a fuel-control element (5), which is designed to influence a supply quantity of fuel depending on a fuel-control signal (13). The control device (10) is designed to receive signals (14) from at least one ionization electrode (7) and to process them into actual values of an ionization current. The control device (10) is designed: to generate a first air-control signal (11) and outputted to the air-control element (3) and to generate a fuel-control signal (13) by adjusting the actual values of the ionization current to the ionization-current setpoint and outputting the signal to the fuel-control element (5); and to generate a setpoint (24) increased by a specified amount from the ionization-current setpoint; and to generate a changed fuel-control signal (13) by adjusting the actual values of the ionization current to the increased setpoint (24) in the case of a first air-control signal (11); and to evaluate the changed fuel-control signal (13) generated based on the increased setpoint (24) by comparing it with a specified maximum value; and based on the evaluation, to detect a blockage. The control device (10) is designed to recognize the blockage based on the evaluation if the fuel-control signal (13) generated using the increased setpoint (24) exceeds the specified maximum value.

In some embodiments, the control device (10) is designed to evaluate the air-control signal (11) and/or the actual values of the ionization current (14) and to check for the absence of a blockage, wherein the blockage is absent if the air-control signal (11) and/or the actual values of the ionization current (14) fluctuate within respectively specified ranges.

In some embodiments, the burner assembly comprises an exhaust-gas tract in fluidic connection with the flame area (2) of the burner assembly, and the blockage is a blockage of the exhaust-gas tract.

In some embodiments, the control device (10) is designed to detect the blockage based on the evaluation if the fuel-control signal (13) generated using the increased setpoint (24) exceeds the specified maximum value during a specified time duration.

In some embodiments, the specified maximum value corresponds to a maximum open setting of the fuel-control element (5).

In some embodiments, the control device (10) is designed to generate a stationary fuel-control signal (13), which makes it possible to control a combustion by the burner assembly in a stable manner within a control range for a stationary control system, depending on a signal (14), which is processed into an actual value of the ionization current, of the at least one ionization electrode (7) and depending on the ionization-current setpoint, and to save the stationary fuel-control signal (13) generated in this manner, wherein the control device (10) is designed to form a difference from the fuel-control signal (13) generated based on the increased setpoint (24) and the stored stationary fuel-control signal (13); and wherein the control device (10) is designed to detect the blockage based on the evaluation of the fuel-control signal (13) generated by the increased setpoint (24) if the form difference or a value generated as a function of the form difference exceeds a specified threshold.

In some embodiments, the control device (10) is designed to generate a stationary fuel-control signal (13), which makes it possible to control a combustion by the burner assembly in a stable manner within a control range for a stationary control system, depending on a signal (14), which is processed into an actual value of the ionization current, of the at least one ionization electrode (7) and depending on the ionization-current setpoint, and to save the stationary fuel-control signal (13) generated in this manner, wherein the control device (10) is designed to form an amount of a difference from the fuel-control signal (13) generated based on the increased setpoint (24) and the stored stationary fuel-control signal (13); and wherein the control device (10) is designed to detect the blockage based on the evaluation of the fuel-control signal (13) generated by the increased setpoint (24) if the formed amount exceeds a specified threshold over an entire specified time span.

In some embodiments, the control device (10) has a communication interface to send error messages and is designed to generate an error message if, based on the evaluation, the blockage is detected; wherein the control device (10) is designed to send the generated error message based on the communication interface.

In some embodiments, the control device (10) is designed to generate a shutoff fuel-control signal (13) to reduce the supply quantity of fuel to zero and output this to the fuel-control element (5) if, based on the evaluation, the blockage is detected.

In some embodiments, the control device (10) is designed to generate another set point (24) subsequent to the evaluation; to generate another changed fuel-control signal (13) by adjusting the actual values of the ionization current to the other setpoint (24), which makes it possible within a control range for a stationary control to regulate a combustion carried out by a burner assembly in a stable manner; and to output the other fuel-control signal (13) to the fuel-control element (5).

In some embodiments, the control device (10) has a settable register value to instigate a test for the presence of the blockage under the use of the increased setpoint (24) and is designed to generate pairs from every single air-control signal (11) and every single fuel-control signal (13); wherein the control device (10) is designed to calculate, from each of the generated pairs, a characteristic curve value (19) made up of the fuel-control signal (13) and the air-control signal (11) so that there is a calculated characteristic curve value (19) for each generated pair; wherein the control device (10) is designed to average the calculated characteristic curve values (19) based on a first specified time constant to a first average value; wherein the control device (10) is designed to average the calculated characteristic curve values (19) based on a second specified time constant to a second average value; wherein the control device (10) is designed to calculate a difference from the first average value and the second average value and compare the calculated difference with a specified threshold; and to set the register value to instigate a test for the presence of the blockage under the use of an increased setpoint (24) if the calculated difference exceeds the specified threshold.

In some embodiments, the air-control element (3) is designed to influence a supply quantity of air depending on an air-control signal (11) by setting a speed (12) within a speed range; wherein the control device (10) is designed to break down the settable speed range into at least two speed ranges (32); to select one of the at least two speed ranges (32); within the selected speed range (32), to generate a second air-control signal (11); to generate a setpoint (24) increased by a specified amount from the ionization-current setpoint; to generate a changed fuel-control signal (13) by adjusting the actual values of the ionization current to the increased setpoint (24) in the case of a second air-control signal (11); to evaluate the changed fuel-control signal (13) generated based on the increased setpoint (24) and to detect the blockage based on the evaluation. In some embodiments, the control device (10) has settable register values for each of the at least two speed ranges (32) and is designed to set the register value for the selected speed range (32) based on the detected blockage.

In some embodiments, the control device (10) is designed to prevent readjustment of the actual values of the ionization current to the increased setpoint (24) in the case of air-control signals (11) within a speed range (32), for which the settable register value is set.

In some embodiments, the register values, which can be set for each of the at least two speed ranges (32), can be deleted and the control device (10) is designed to delete all of the registered values, which can be set for each of the at least two speed ranges (32).

As another example, a burner assembly may comprise a flame area (2) and at least one ionization electrode (7) arranged within a flame area (2) of the burner assembly and an air-control element (3), which influences a supply volume of air depending on an air-control signal (11), and a fuel-control element (5), which influences a supply quantity of fuel depending on a fuel-control signal (13); the burner assembly additionally comprising a control device (10) as described above, wherein the control device (10) is communicatively (11-14) connected with the at least one ionization electrode (7), the air-control element (3) and the fuel-control element (5).

BRIEF DESCRIPTION OF THE DRAWINGS

Various details are made accessible to the person skilled in the art based on the following detailed description. Thereby, the individual embodiments are not limiting. The drawings, which have been enclosed with the description, can be described as follows.

DETAILED DESCRIPTION

Figure 1:
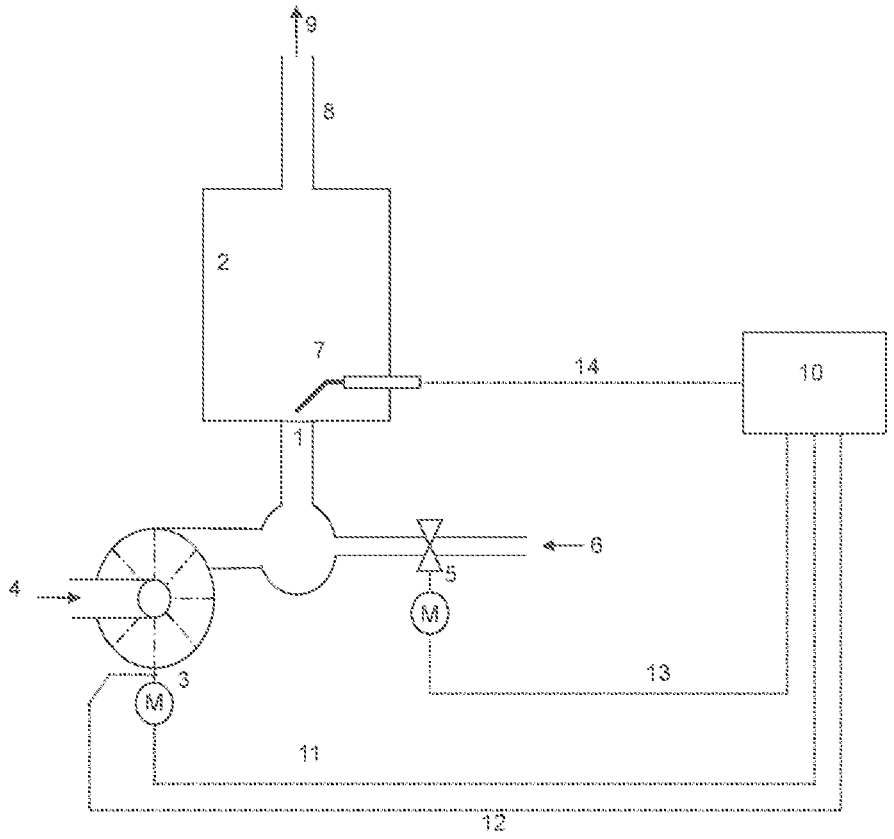
FIG. 1 schematically shows a burner assembly with an air-supply duct and a fuel-supply duct.

The teachings of the present disclosure may be embodied in a method and/or a controller to detect drift of the ionization signal due to the formation of deposits and/or bending of the ionization electrode without certain determined speeds within a specified span of time having to be reached. Example methods and control devices for a burner assembly may be used to detect coverings and/or blockages. The avoidance of undesired emissions of carbon monoxide (CO emissions) is associated with this. A technical analysis of control limits of an ionization-current control circuit after the ionization-current setpoint has been changed in relation to normal standard operation. A covering and/or a blockage of the air-supply duct and/or the flue of a burner assembly is assumed if the control circuit operates outside of its control limits.

Furthermore, example methods may reveal undesired emissions due to drift due to the formation of deposits and/or bending of the ionization electrode. In some embodiments, the method can be carried out at each speed point without requiring special characteristic values for individual speed points to be stored.

In some embodiments, the speed of a fan in the air-supply duct and/or in the flue of a burner assembly is initially determined. From the speed of the fan, preferably, a setpoint of ionization current of an ionization electrode is determined under the use of a characteristic curve. The determined ionization-current setpoint is then increased by one increment. Following this, an attempt is made to control the fuel factor of the burner assembly at a constant fan speed under the use of the increased ionization current. If the control circuit fails during this attempt, a conclusion entailing a combustion having the undesired level of emissions and/or being near this level is made. Such a combustion is, for example, caused due to covering and/or blockage and/or due to the formation of deposits and/or bending. Accordingly, an error is output. The method described here may be referred to as a test for stationary control with an increased ionization-current setpoint and/or a test for stationary control.

In some embodiments, the burner assembly is shut down and/or locked as a response to the control circuit failing. In some embodiments, the burner assembly is shut down and/or locked by closing a fuel actuator.

In some embodiments, an attempt is made to adjust the fuel actuator of the burner assembly at a constant fan speed under the use of an increased ionization-current setpoint in accordance with a proportional and integral rule or according to a proportional and integral and derivative rule.

In some embodiments, prior to increasing the setpoint of the ionization current, an attempt is made to adjust the burner assembly in such a way that the fan speed and the ionization current are kept stable within specified limits. If this is not possible, this results in the setpoint of the ionization current being increased by a specified increment.

In some embodiments, prior to increasing the setpoint of the ionization current, the behavior of the setting of a fuel actuator is analyzed for changes and/or stability with reference to the fan speed. For this, the current setting of a fuel actuator and a fan speed are detected. From fan speed, a low-calorific setting of the fuel actuator, which is part of the low-calorific characteristic curve, is determined under the use of a low-calorific characteristic curve. From fan speed, furthermore, a high-calorific setting of the fuel actuator, which belongs to the high-calorific curve, is determined under the use of a high-calorific characteristic curve. The current setting is compared with the low-calorific setting and the high-calorific setting of the fuel actuator. A relative position, e.g., in percent, is determined, which indicates the position of the current setting relative to the low-calorific and to the high-calorific setting of the fuel actuator.

In some embodiments, the method includes taking an average of the temporal change and/or the temporal fluctuation of the relative position into a first average value based on a first low-pass filter using a first time constant. Furthermore, the temporal fluctuation of the relative position is averaged is averaged into a second average value based on a second low-pass filter using a second time constant. The first and the second average values are compared with each other. If the first and the second average value deviate from each other by a specified threshold value, an increase in the setpoint of the ionization current by one specified increment results.

In some embodiments, the recognition of a covering and/or blockage is also possible if the fluid flow in the air-supply duct and/or the flue is set based on a fan speed and not detected using a sensor.

In some embodiments, at least one actuator is controlled and/or adjusted using a pulse-width modulated signal. In some embodiments, at least one actuator is controlled and/or adjusted using a converter.

The teachings may enable a method and/or a control device for a burner assembly, based on which a covering and/or blockage of the air-supply duct and/or flue can be detected during the operation of a burner assembly. In some embodiments, the system to detect a covering and/or blockage does not have to be decommissioned.

In some embodiments, the control device breaks down the settable speed range into individual ranges, wherein a test for stationary control with an increased level of ionization current in the case of any speed within a range is representative for testing for stationary speed in the case of each speed within the range.

In some embodiments, a test for stationary control with an increased level of ionization current has been successfully carried out and to not carry out any more testing for stationary control within a marked range during operation and/or to request and/or carry out a test for stationary control within a marked range during operation.

In some embodiments, the markings or all markings are simultaneously reset/deleted within defined time periods.

In some embodiments, a test for stationary control is started if other methods of monitoring a drift of the ionization electrode cannot be carried out over a specified time duration because the specified speed points cannot be reached.

FIG. 1 shows a block diagram of a burner system consisting of a burner 1 and a combustion chamber 2 with a heat exchanger. A motorically driven fan 3 conveys the combustion air supply 4 to the burner 1. Before the burner 1, a fuel 6, e.g. a combustion gas is added to the combustion air. The quantity of the additive fuel is set via a motorically adjustable fuel valve 5. The fuel quantity is transmitted to the fuel valve 5 via the control signal 13 from the adjustment, control and/or monitoring unit 10. This can take place by means of an analog signal, as a pulse-width modulated signal or, however, also a digital signal, for example, via a bus system. The air volume is transmitted to the fan 3 via the signal 11 from the adjustment, control and/or monitoring unit 10. This value 11 can likewise be transmitted as an analog signal, as a pulse-width modulated signal or also, however, as a digital signal, for example, via a bus system. The fan then sets the air volume according to the transmitted signal. It sends a speed signal 12, which corresponds to the speed of the fan propeller, back to the adjustment, control and monitoring unit 10. The reason for this is that the fan does not respond to the control signal 11 in an adequately reproducible manner, for example, due to the friction of the bearing of the fan propeller due to various operating conditions, such as temperature and/or start behavior. Thereby, the air volume can only be set via the speed 12 of the adjustment, control and/or monitoring unit 10, for example, via a closed speed circuit (reproducible).

With the aid of an ionization electrode 7, monitoring takes place to determine whether a flame is present on the burner 1. The fuel-to-air ratio can also be determined based on the ionization signal 14, which is read into the adjustment, control and/or monitoring unit 10 with the aid of the electrode 7. This happens by applying an alternating voltage to the ionization electrode 7. Thereby, the average direct current component of the current through the ionization electrode 7 is measured.

An ionization electrode 7 detects an ionization current. Typically, there is an alternating voltage within a range of 110 V . . . 240 V applied to the ionization electrode 7. Due to the diode effect of the flame in the power circuit between the ionization electrode 7 and the counter-electrode, normally being the burner 1, a direct current flows through ionization circuit superimposed with an alternating current. This direct current increases as the ionization of the gas within the flame area increases. On the other hand, the direct current decreases as the combustion's excess air increases. For the further processing of the signal of the ionization electrode, it is common to use a low pass so that the ionization current arises from the filtered ionization signal. The occurring direct current is typically within the range of less than 150 microamperes, frequently even considerably under this value.

A device to separate direct current and alternating current of an ionization electrode is, for example, shown in EP1154203B1, FIG. 1, and explained, among other things, in section 12 of the description. Here, reference is made to the relevant parts of the disclosure of EP1154203B1.

Ionization electrodes 7 like the ones used here are commercially available. Many times, KANTHAL®, e.g. APM® or A-1® is used as a material for the ionization electrode 7. Electrodes made of Nikrothal® are considered by a person skilled in the art.

The exhaust gas 9 generated by the combustion process and cooled in the heat exchanger 2 is lead outside through a flue 8, the length of which differs from system to system. The flue 8 can furthermore be partially or fully sealed and/or blocked due to external factors. In the case of a partial seal and/or a partial blockage of the flue 8, a first section of the flue 8 is open and a second section of the flue 8 is locked and/or blocked. Such external factors include, for example, a faulty constriction and/or covering of the exhaust-gas tract 8 by craftsmen, due to malfunction of the exhaust-gas flap and/or the exhaust-gas tract 8 icing up in the winter. The cross section for the air supply 4 can faultily be constricted due to the same causes. The air-supply duct 4 is therefore assigned to the flue 8 with regard to its effect. Due to the air-supply or the exhaust-gas tract 8 being constricted, the measured speed signal 12 is assigned to another air flow rate 4 than this was the case when setting the characteristic curve according to FIG. 2.

Figure 2:
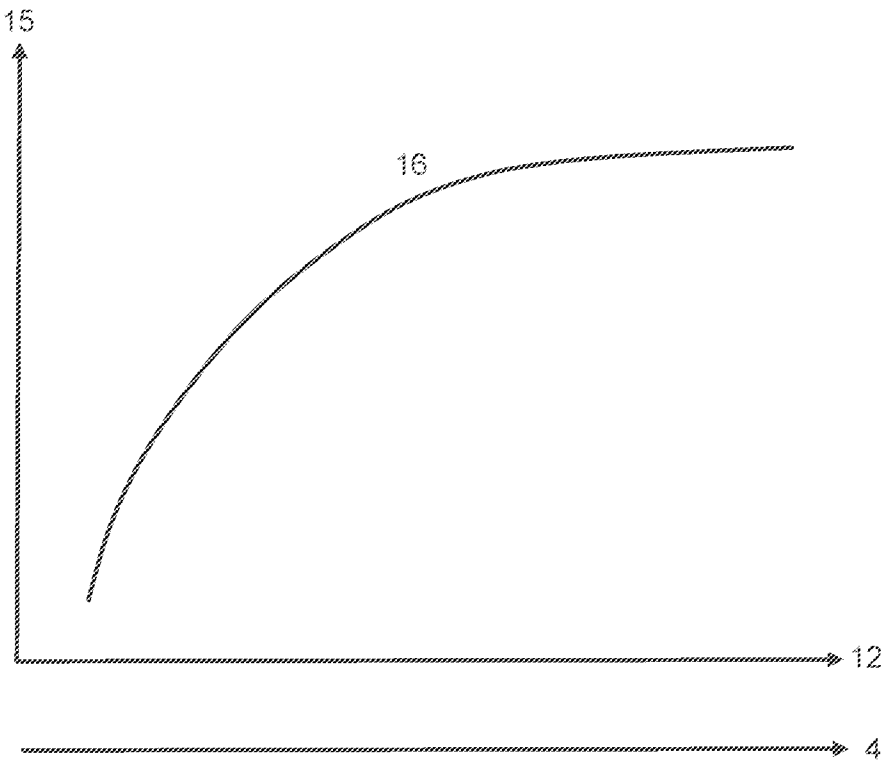
FIG. 2 shows a characteristic curve of an ionization current over a fan speed.

In FIG. 2, an ionization-current setpoint 15 is assigned to the measured speed 12 over a characteristic curve 16. Thereby, the speed 12 corresponds to an air flow rate 4 relating to the current resistance of the air-supply/exhaust-gas tract 8 as was the case when establishing the characteristic curve 16. Changes in length, in cross section, bends, etc. of the air-supply/exhaust-gas tract 8 within a specified tolerance of the current resistance only have a slight effect on the assignment of speed 12 to air flow rate 4. Thereby, an air flow rate 4 is defined in an adequately precise manner via a specified speed 12. An ionization-current setpoint is set over the characteristic curve 16. Thereby, the fuel quantity 6 is adjusted via a closed control circuit in such a way that the measured ionization current 14 is identical to the specified setpoint from the characteristic curve 16. This means, the air volume is assigned to the fuel quantity within specified tolerances.

If the resistance of the current changes due to a covering, the linear assignment of the speed 12 to the air flow rate 4 can change. For a specified speed 12, the correct air flow rate 4 is no longer assigned to the fuel quantity 6, which is set over the characteristic curve 16, the control circuit and the ionization current 14. This error can be so great that the air-ratio increment λ moves closer to λ=1. The results include bad combustion values with a high level of CO.

For the characteristic curve 16 of the ionization-current setpoint 15 over the measured fan speed 12 shown in FIG. 2, a dependence of the fuel flow rate 6 over the speed 12 results via the closed control circuit. The closed control circuit adjusts the fuel quantity 6 so that the actual current-ionization value 14 is identical to the setpoint 15. The fuel flow rate 6 is represented by the fuel-valve control system 13 since the control system 13 and the fuel flow rate 6 can be clearly assigned to each other in a reversible manner. This applies at least as long as the air volume is kept constant. As an alternative, the fuel flow rate 6 could be detected directly by a flow-measurement device.

Figure 3:
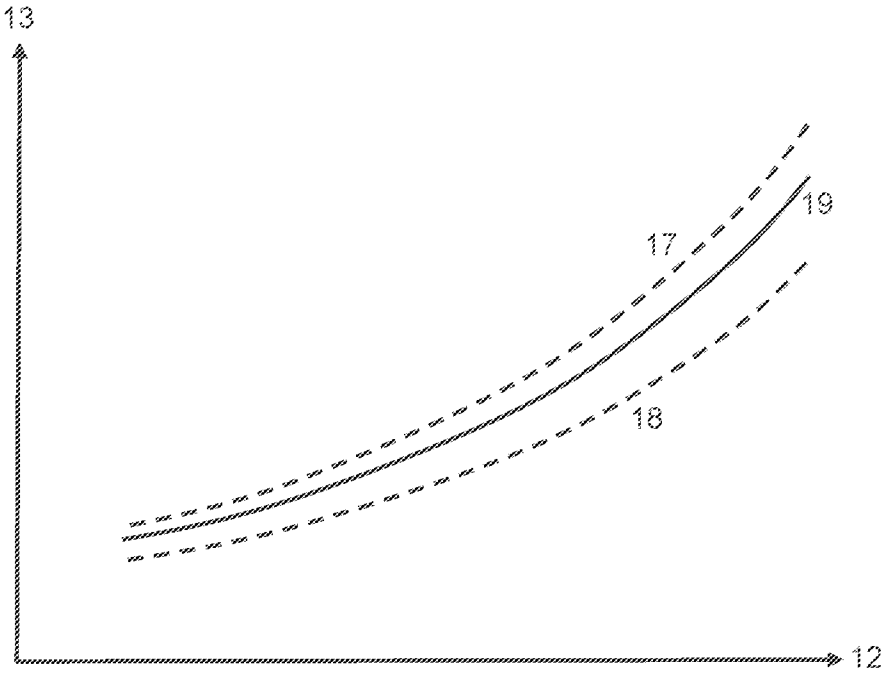
FIG. 3 shows a low-calorific, a currently used and a high-calorific progression of the fuel supply over the fan speed.

The dependence of fuel actuator control system 13 as a measure of the fuel flow rate 6 of the fan speed 12 as a measure for the air flow rate 4 is shown in FIG. 3. Since, in addition to valve characteristics, the characteristic curve is dependent on external conditions, such as fuel and/or fuel-input pressure, two characteristic curves 17 and 18 are initially stored in the burner control system 10. Both characteristic curves 17 and 18 correspond to fixed, however different external conditions. In this way, the characteristic curve 17 was, for example, determined by means of a low-calorific fuel and/or a low level of fuel-input pressure.

On the contrary, characteristic curve 18 was determined by means of a higher-calorific fuel and/or a high level of fuel-input pressure. The currently applicable characteristic curve 19 is determined by the actual stationary fuel setting 13 detected by the control device 10 with setpoint 15 and actual value 14 of the ionization current being identical. All other characteristic curve points of the characteristic curve 19 are then determined from this point and the two characteristic curves 17 and 18 as an (geometrical and/or arithmetical) average value weighted with a factor R. R can be determined from the position point 13 of the fuel valve at a given speed 12 and both points lying on the characteristic curves 17 and 18 at the same speed 12. In other words: At any speed 12, the ratio of the distance between the characteristic curves 19 and 17 to the distance between the characteristic curves 19 and 18 is identical. By taking this measure, the power can quickly be reduced. This target point is very close without the control device 10 considerably having to intervene in the case of a power-output change.

By monitoring the weighting factor R, a potential covering and/or blockage of the air-supply/exhaust-gas tract 8 can be revealed. In the case of a covering, due to an incorrect assignment between the speed and the air flow rate, the characteristic curve 19 moves closer to the characteristic curve 17 for the low-calorific gas, which becomes noticeable due to a change in the weighting factor R. To detect this, the weighting factor R is averaged in two ways. On the one hand, the weighting factor R is averaged over a period of time, for example, 10 seconds, 15 seconds or 20 seconds. On the other hand, the weighting factor R is averaged over a longer period of time, for example, 30 seconds, 45 seconds or 60 seconds. The averages help to attenuate the fluctuations in the system even better. For example, moving-average filters and/or low-pass filters are used as an averaging means.

If the normalized difference between the shorter average and a longer average deviates by a given threshold, a far-reaching, preferably a complete or substantially complete covering and/or partial covering could have occurred. As a result of the partial covering, the combustion could be critical. For example, a value of 5 percent of the lower value or of 20 percent of the lower value or even 100 percent of the lower value is taken into consideration as a threshold value for a normalized difference.

A separate test procedure may be performed to check if there is really a covering and/or a blockage present. The special test is required since other causes for a change of the weighting factor R can also come into question, e.g., a change of the fuel and/or the fuel-input pressure.

Figure 4:
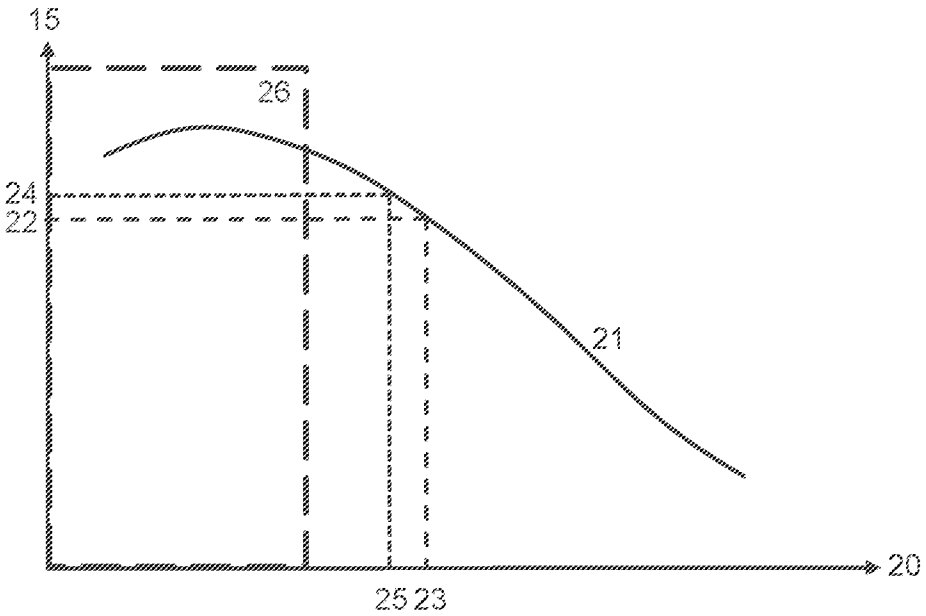
FIG. 4 shows the progression of an ionization-current setpoint over an air-ratio increment in the case of a non-existent blockage.

The test procedure for covering is illustrated by FIG. 4. In it, the ionization-current setpoint 15 over the air-ratio increment λ 20 is shown. For each power level, represented by the speed 12, a characteristic curve 21 results, which is determined by the burner electrode system 1, 7 and the air-supply/exhaust-gas tract 8. It is in normal mode, the setpoint current 22 for the currently specified speed 12 is determined from the characteristic curve 16 in FIG. 2. The measured ionization current 14 is set to the same setpoint 15 via the closed ionization-current control circuit. The setpoint 15 is identical to setpoint current 22 for this speed. Over the characteristic curve 21, the desired λ value 23 results for the current speed value 12. When performing the covering test, the current speed of 12 is adhered to. It is checked if the speed 12 and the ionization current 14 are stationary at the desired setpoint so that the generation of a test request to the stationary control system is not falsified by the influenced of rapid power-output changes of the burner assembly.

In some embodiments, a sufficiently stationary status is present if the speed 12 and the ionization current 14 respectively fluctuate around their average value by less than 1 percent, preferably less than 10 percent, even more preferably by less than 50 percent. In particular, variance and standard deviation are taken into consideration as a measure for the deviation around the average value. According to a special embodiment, no detected measurement value may be outside of the range over a specified time duration, for example, at least 2 seconds, at least 10 seconds, or at least 20 seconds. As an alternative, the speed measurement values 12 are compared with each other at regular intervals. A stationary state is also predominate here if the last measured speed 12 deviates by less than 1 percent, less than 10 percent or furthermore less than 50 percent from the previously measured speed value 12. Typical regular intervals for comparison include speed values 12 of at least 2 seconds, at least 10 seconds or at least 20 seconds.

Only after a sufficiently stationary status and/or stability is present will the next text step be introduced where the ionization-current setpoint 15 is increased to a value 24 in the case of a closed control circuit. The increase of the ionization-current setpoint in the case of a closed control circuit to a value 24 is, for example, an increase of 5 percent, by 20 percent or by 100 percent measured from the previously set ionization-current setpoint.

Thereby, the speed 12 is kept constant. As is shown in FIG. 4, if the characteristic curve 21 did not change because no covering is present, after short period of time, the actual value 14 is also adjusted to the setpoint 24. The short time is, for example, 3 seconds or 10 seconds or 20 seconds. In accordance with the characteristic curve 21, the λ value 25 results. The ionization-current control circuit provides a stable result. As can be seen in FIG. 4, value 23 for this case is still sufficiently far from the critical λ range 26, in which CO emissions occur. For example, the critical λ range comprises air-ratio increments λ smaller than 1.15, in particular, smaller than 1.10, smaller than 1.05 or even smaller than 1.00.

After ending the test, if the control circuit remains stable, the setpoint is set to the operating value 22. After a short waiting period for the control circuit to respond, the speed 12 freeze is lifted. The short waiting time until the control circuit starts is, for example, 1 second or 5 seconds or 10 seconds. The speed specification and therefore, the power-output setting can be taken up again by subordinate units, for example, by a temperature regulation system.

If the test is passed as in the presented case, other tests can take place at short time intervals, for example, being more than a minute. The other tests take place until a determined number of tests, for example, 5 tests or 10 tests or 15 tests have been passed. Furthermore, a test can be requested and/or carried out even after a power change, meaning after a burner modulation and/or after a burner start.

In some embodiments, the test can be requested after changing a speed by certain value if the speed 12 is sufficiently stable at a status. A test can also be required cyclically at certain specified time intervals. In another case, a test request occurs after a specified time interval on a cyclical level and/or after speed changes. The mentioned options are available if, for example, another control algorithm without a weighting factor is used.

Figure 5:
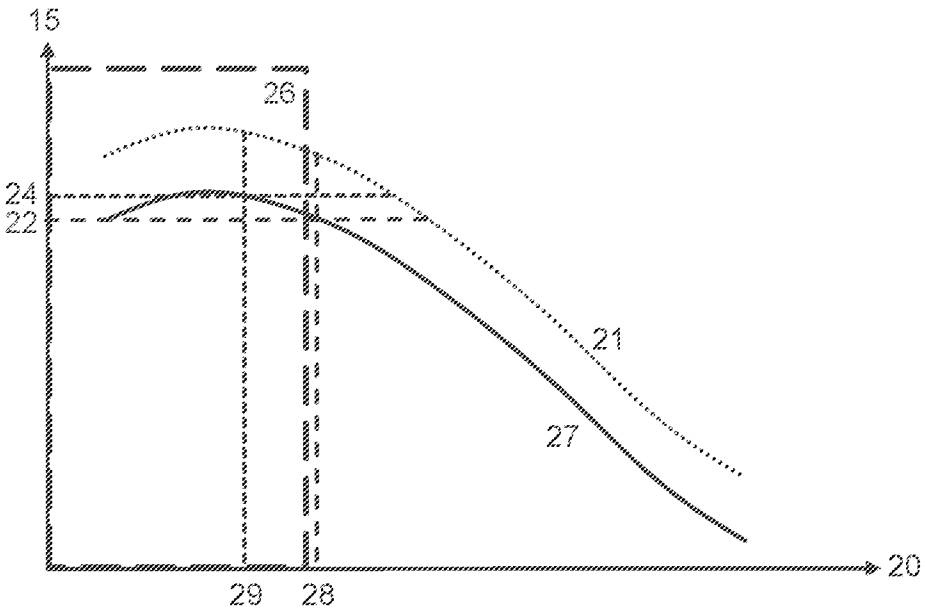
FIG. 5 shows the progression of an ionization-current setpoint over an air-ratio increment in the case of partially present blockage.

In FIG. 5, the behavior of the test procedure is illustrated if a covering and/or a blockage is present so that no critical combustion values occur during normal operation. In this case, the characteristic curve 21 dependent on the burner system changes and shows a progression as shown by characteristic curve 27.

For the given speed 12, the same ionization-current setpoint 22 results again from characteristic curve 16 in FIG. 2. Due to the change progression of characteristic curve 27 with relation to characteristic curve 21, the resulting λ value 28 for the operating scenario shifts to a smaller value with relation to the value 23. If the aforementioned test procedure is carried out, when increasing the ionization-current setpoint 15 to the value 24 in the case of a closed control circuit, only just one point can be found on the characteristic curve 27. Each point allows for the ionization current control circuit to be set to value 24 in a stable manner. For the test case, a λ value of 29 results, where CO emissions are already generated. However, this is not critical since the status only lasts for a very short period of time because the ionization current 15 is reset to the operating value 22 after passing the test. Furthermore, the speed of 12 will be approved after passing test. The status with CO emissions may take less than 15 seconds, less than 10 seconds, or less than 5 seconds.

Figure 6:
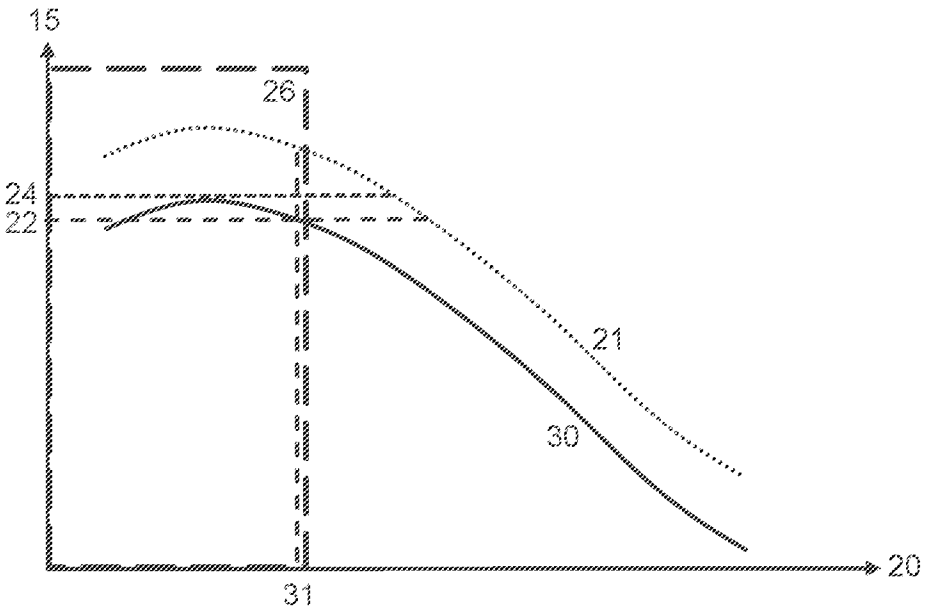
FIG. 6 shows the progression of an ionization-current setpoint over an air-ratio increment in the case of progressive blockage.

In FIG. 6, the behavior of the test procedure is shown if a covering and/or a blockage is present which generates critical combustion values. On the contrary, in the operating scenario, the value 22 of the ionization-current setpoint is determined by characteristic curve 16 in the case of a stable speed 12. For the characteristic curve 30 changed by covering the air supply/exhaust-gas tract 8 even more with relation to the correct characteristic curve 21, a λ value 31 results for the operating scenario. The λ value 31 is already within the critical combustion range with high CO emission levels. If the aforementioned test procedures carried out now, no point can be found on the characteristic curve 30 for the set ionization-current setpoint 24. The ionization current control circuit searches for a corresponding value by reducing λ by means of continuously increasing the fuel quantity, in particular, the gas quantity. The control circuit breaks. Due to the decrease of the ionization current with the air-ratio increment λ 20 in characteristic curve 30 for $\lambda<1$, the effect even strengthens. The fuel valve 5 arrives at its maximum opening position. It moves to the end-stop or a flame loss already results beforehand.

In the present case, the control circuit sends a signal to the fuel valve taking a setpoint of the ionization current into account. In the case of a failure of the control circuit, the ionization-current control circuit at a given ionization-current setpoint does not find any suitable air-ratio increment λ and no suitable stationery setting of the fuel valve anymore. As a consequence, within the critical combustion range, at least one setpoint of the ionization current exists, for which a stationary mathematical transmission function does not remain finite. Thereby, the mathematical transition function describes the output of the control circuit to the fuel valve as a response to a finite measurement value of the ionization current. In some embodiments, the mathematical function describes the output of the control circuit without taking technical limits for the output signal of an electrical control circuit into account.

Stationary control (of a combustion by the burner assembly) means that no changes of the output values to the fuel-control element occur anymore in the case of constant (changes of the) input values (into the) of the transmission function after a finite time and after transient responses subside. In this context, input values include the ionization-current setpoint and/or external disturbances. Overall, in a stationary status, all system values are at a fixed unchanged value in the case of fixed input values, such as ionization-current setpoint and/or disruptive values. In some embodiments, this applies to the output quantities of the control circuit to the fuel valve. This also applies to the control signal 13 to the fuel valve 5 accordingly.

Apart from that, the transmission function is the transmission function of the closed control circuit including the transmission function of the control and measurement path (as sub-functions). The measured value, actual current-ionization value, but also the valve control system for the controlled section, are internal system values for the transmission function of the control circuit. Other control circuit functions include the actual target value comparison and the controller, as well as a possible driver for the valve control system.

The control circuit, for example, is a proportional/integral control circuit and/or a proportional/integral/derivative control circuit. Breaking of the control circuit is detected if the control signal 13 has exceeded the value for the maximum possible open setting of the fuel valve 5. In several cases, the maximum possible control 13 of the fuel valve is limited and/or the lift of the maximum open setting of the fuel valve 5 is measured. A break of the control valve is detected if a specified time duration has been exceeded, in which the fuel valve 5 is at its maximum setting. If there is a possibility of detection of a broken control circuit includes the detection of exceeding a time duration, in which the actual ionization-current signal 14 is outside of a range around the ionization-current setpoint 24 defined within the adjustment, control and/or monitoring unit 10 during the test phase with an increased ionization-current setpoint 24. In accordance with another possibility to detect a break of the control circuit, the flame lost during the test can be taken into account as a break of the control circuit.

The difference between the ionization-current setpoint in the operating scenario 22 and the ionization-current setpoint in the test scenario 24 determines the point, based on which the critical range 26 is defined. Thereby, the maximum CO value without a safety shutoff including a possible safety distance can be determined by means of this difference. In a particularly preferred embodiment, only a single difference for all speed values 12 is defined within the adjustment, control and/or monitoring unit 10. Then, the difference must be selected in such a way that the highest value for a covering with a related change of the curve 21 must be selected from all possible fan speeds 12. The fan speeds 12 correspond to all possible burner output levels with related critical ranges 26.

In some embodiments, a method includes selecting a difference for each of a plurality of significant speeds. For the speeds, interpolation is performed between these significant speeds based on the various differential values. In some embodiments, interpolation is carried out in a linear manner. In some embodiments, interpolation is performed based on so-called cubic splines. In some embodiments, the significant speed values contain the maximum and the minimum modulation degree of the system. The person skilled in the art recognizes that the significant speed values are not limited to the maximum and minimum modulation degrees.

If a break in the control circuit is detected, a critical combustion in an operating scenario or a combustion near to critical values can be assumed. A safety shutdown of the burner system with a subsequent lockout position is provided as a response. Thus, maintenance can be performed on the system.

In some embodiments, the system with or without a safety shutdown can continue to operate, wherein then, a plurality of tests are repeated shortly after the unsuccessful test. A lockout position only occurs after a specified number of unsuccessful tests and/or after a specified relative frequency of unsuccessful tests. This procedure has the advantage that short-term coverings and/or very strong factors, which simulate a covering of the air supply/exhaust system 8, do not cause system failure. Thereby, a high level of availability is ensured. Short-term coverings and/or very strong factors include strong wind, for example.

In some embodiments, the method includes shifting the ionization-current setpoint 14 around a specified increment until the test, which is conducted at short intervals, is successfully passed. Here however, the increased availability is faced with a time duration of the operation during the series of tests when the unit can generate critical emissions. For potential coverings and/or blockages, which pass by quickly, this response is less preferred. In this case, preferably, a very great (considerable) correction should be selected. The characteristic curve 16 can be precisely corrected via other known drift corrections at the corresponding speed points.

In principle, using the described test procedure, other errors can also be revealed that influence the burner electrode system 1, 7. In this way, naturally, a drift of the ionization electrode 7 due to deposits and/or bends can be revealed. In relation to other known methods, a correction of the ionization-current setpoint 14 is rather difficult and/or imprecise to execute. To this end, the method has the advantage of immediately revealing a rapid characteristic curve change 21. Furthermore, the method has the advantage that an immediate response can take place due to revealing a rapid change. Thus, the various methods complement each other.

The test is representative for a specific speed range of the speed 12. Such a validity range typically include ±300 revolutions per minute, ±400 revolutions per minute or ±800 revolutions per minute depending on the fan type. As soon as a test is requested, after every power-output adjustment (modulation) over the fan speed 12, which is greater than the specified range, another test must be carried out. Likewise, a new test is required after every start-up. Tests are carried out after a speed change 12 (power-output adjustment) and/or after each commissioning until a specified number of tests are passed. According to a special embodiment, tests are carried out until a specified percentage of tests have been passed. Preferably, at least 50 percent, furthermore preferred at least 80 percent, particularly preferred at least 95 percent of the tests are passed.

Figure 7:
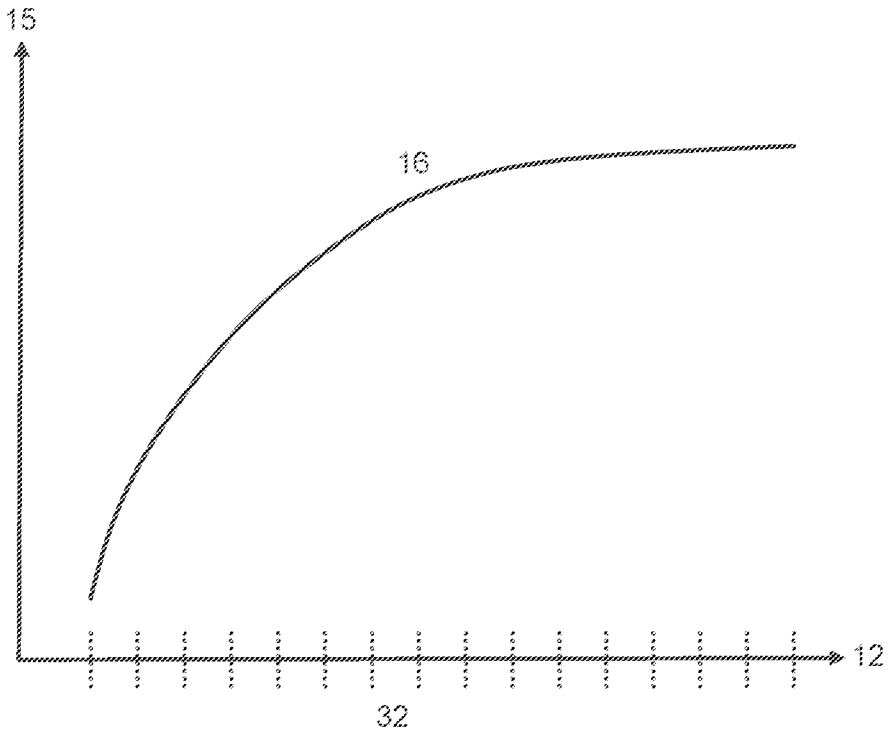
FIG. 7 shows a characteristic curve of an ionization current over a fan speed with a segmented breakdown into speed ranges.

In some embodiments, the method includes breaking up the speed range in which the burner system functions into fixed ranges. This case is shown for the control setpoint characteristic curve in FIG. 7. If a test procedure is carried out at a speed 12 within a range 32, it can be assumed that this test is sufficiently valid for all speeds 12 within the range 32. Consequently, sufficient distance from the critical combustion values for all speeds 12 within the range is at hand. The range 32 can be marked as tested. Operation within the marked speed range is noncritical until, for example, a sufficiently strong change of the weighting factor for the tested marked range 32 is determined.

The ranges 32 are of an advantage if a test has been required and it was passed. In this way, it can be ensured that subsequent tests are only really carried out in the case of another speed 12 from another range 32. The test series is ended after the tests have been successful in the case of speeds 12, which are located sufficiently far away from each other.

Such ranges typically include ±300 revolutions per minute, ±400 revolutions per minute or ±800 revolutions per minute depending on the fan type. The person skilled in the art recognizes that the ranges 32 can also overlap so that a single test can be assigned to two ranges 32. Instead of this, you could also define fewer ranges and in lieu of this, determine a higher range. By this measure, the number of tests can be reduced. Thereby, the distance of speeds 12 are increased.

The presented test procedure within the defined speed ranges 32 comes into a fact as another important application when other drift-test mechanisms cannot be used. As is known, the drift of a burner electrode system by means of deposits and/or by bending the ionization electrode must be detected at regular time intervals at specific speed points. The respectively defined speed point must be achieved to perform the drift test. The heat must be dissipated for a period of time, however brief. In particular, in the case of very small speeds corresponding to small burner output power levels, such tests are very difficult to carry out due to wind factors. If, in the case of greater speeds, the drift-test points cannot be reached because the heat cannot be dissipated, the system must carry out the shutdown before the drift-test point is reached. Thus, the drift test cannot be conducted.

If such a drift test and a subsequent correction of the ionization-current setpoint 15 is not carried out beyond a specified time duration, normally, the burner system would have to be shut down and locked. In such a case, a drift due to deposits on the ionization electrode and/or bending of the ionization electrode can no longer be ruled out. As a result, critical emissions might occur. By carrying out the alternative tests disclosed here, the availability can be (considerably) increased. In the end, the tests can be carried out at any stable speed 12. In addition, the test during is briefly spoken aloud, for example typically 5 seconds or 10 seconds. Thus, the heat can in any case be dissipated.

A test disclosed here is then requested and carried out if the specified time duration for a drift correction has expired and a drift correction could not be carried out. All speed ranges 32 are initially marked as not tested. In range 32, in which the speed 12 is currently sufficiently stationary, the test is then carried out. This range 32 is marked as tested if the test was successful. Upon reaching a different range 32 with a sufficiently stationary speed 12, a test is then carried out in this other range 32. This other range 32 is also marked as tested in the case of a successful test procedure. In all ranges 32, which are marked as tested, no test is carried out anymore if the speed 12 of one of those ranges 32 is reached again. The test is carried out at ranges 32 that are not marked as tested. The respective speed range 32 is marked as tested after subsequently carrying out the test successfully.

This process takes place until a specified time has expired, in which a critical drift could occur. Then, all markings are reset and the tests for each new non-marked range 32 is requested and carried out. The alternative tests are carried out including resetting the range markings until a speed 12 is reached and there, a drift correction has been successfully carried out in accordance with a known method.

A safety shutdown with a lockout position only takes place if a test has not been passed, meaning a critical status has occurred and/or there is a threat that it may occur. Furthermore, in this case, the respective speed range 32 can remain marked as not tested. The tests can be repeated a multiple of times until a lockout position is generated after a certain number of unsuccessful tests have occurred. Thereby, availability is further improved.

In some embodiments, a lockout position occurs when no tests have been carried out during the specified time, meaning also that no stationary status has been achieved even over the short-term. For this very improbable case, a safety shutdown with a lockout position is recommended since the burner power output is in stable over a longer period of time. By means of the aforementioned measure of action, the availability of the burner system can be considerably increased. In some embodiments, an increase of availability in the case of non-executable drift tests and a detection of a spontaneous covering and/or a spontaneous blockage can be combined with one another.

In some embodiments, detection of blockages and/or coverings may be based on a neural network. Thereby, the neural network has a series of input neurons, which, together, form the input layer. The input neurons are set with input data such as the fuel valve setting 13, ionization current 14, and fan speed 12. In some embodiments, the input data are normalized before the input neurons are set. In some embodiments, the method includes normalizing the input data x respectively after a method according to Gauss taking the average value μ and the standard deviation σ of the respective input data into consideration. Thereby, a normalized value $x_{standard}$ results according to:

$$x_{standard} = \frac{x - \mu}{\sigma}$$

The neural network furthermore has at least one output neuron. The output neurons in their entirety form the output layer. In a special embodiment, the at least one output neuron outputs a number between 0 and 1 or between 0% and 100%, which indicates the degree of a covering and/or a blockage. The output neuron of the special embodiment can, for example, be implemented based on a sigmoid or a hyperbolic tangent (tan h) activation function.

In some embodiments, the at least one output neuron outputs a number, such as 0 or 1 for example, which, in the case of 0, indicates that no covering and/or blockage is present. In the case of an output of 1 in turn, a covering and/or blockage is present. The output neuron of the simplified embodiment can be implemented, for example, based on a step function.

In some embodiments, the neural network has at least two output neurons. Among these, a first output neuron corresponds to the special embodiment from above, which means that a degree of covering is indicated. It outputs 0 or 1 corresponding to no covering or a covering present.

The neural network furthermore has at least a hidden layer of neurons. In some embodiments, the at least one hidden layer of neurons has 7, 8 or 9 neurons. In accordance with another embodiment, the at least one concealed layer of neurons has 3, 4 or 5 neurons. The neurons of the hidden layer are typically perceptron neurons, which function in accordance with a sigmoid or a hyperbolic tangent (tan h) activation function.

In some embodiments, each neuron of at least one hidden layer is connected to each neuron of the input layer. In some embodiments, each neuron of at least one hidden layer is connected to each neuron of the output layer. In some embodiments, each neuron can have a distortion connection and/or a distortion parameter, which co-determine(s) the activation function of each neuron.

The connections of the neuronal network have weightings, which are determined by means of the neuronal network learning. In a special case, the neural network is trained via backpropagation. In addition, a set of input and output values determined under test conditions are used. At the same time, an error function is defined. The error function is then minimized via a process such as backpropagation under the given input and output values. In accordance with another embodiment, an evolutionary algorithm, for example, a genetic algorithm is used to minimize the error function.

In some embodiments, the learning processes can be combined among one another to minimize the error function. In this way, for example a set of weightings can be determined based on a genetic algorithm, which is near the global minimum. Then, the global minimum of the error function is determined via backpropagation and/or via a gradient dissent method. The combined use of learning methods has the advantage that a global minimum and not only a local minimum of the error function is determined with a high level of probability.

In some embodiments, in the case of the error function, a differentiation can be made between first- and second class errors.

In this way, the neuronal network can be trained in such a way that coverings and/or blockages can be detected with a high level of probability. At the same time, in this case, there is the possibility of falsely reporting a covering and/or a blockage. In another case, the neuronal network can be trained in such a way by choosing an error function that disruption-free operation is ensured to the furthest extent possible. In any case, it can occur that a covering and/or blockage is not detected. In this case, it is also possible that a covering and/or blockage is only detected when this is at a considerably advanced stage. The person skilled in the art recognizes that the neural network disclosed here can also be used to detect the drift of an ionization electrode and/or other statuses of a burner assembly.

The neural network can be practically implemented on the control device 10 by storing the structure of the network within the control device 10. For example, the quantity and type of neurons per layer and the connections between the neurons are part of the structure of the network. At the same time, an optimal set of weightings of the connections are stored. The control device loads to evaluate a situation at hand of the neuronal network according to the stored structure. Furthermore, the weightings of the connections are set according to the stored set. Then, the input parameters such as fuel supply 13, fan speed 12 and the signal of the ionization electrode 14 are in any case normalized and set as input values. By activating the neuronal network, this generates one or a plurality of output values which indicate(s) a covering and/or blockage and/or the degree thereof.

It is proceeded as usual with the output value or output values.

For example, the output values can instigate locking and/or error messages. In some embodiments, when the neuronal network indicates a covering and/or blockage, and aforementioned test is carried out by the control device 10 during stationery operation.

In some embodiments, parts of a control device or a method are implemented as hardware, as a software module, which is carried out by a computing unit, or based on a cloud computer, or based on a combination of the aforementioned possibilities. The software might comprise a firmware and/or a hardware driver, which is carried out within an operating system or an application program. The present disclosure also refers to a computer-program product, which contains the features of this disclosure and carries out the required steps. In the case of implementation as a software, the described functions can be saved as one or a plurality of commands on a computer-readable medium. Some examples of computer-readable media include random access memory (RAM), magnetic RAM (MRAM), read only memory (ROM), Flash memory, electronically programmable ROM (EPROM), electronically programmable and deletable ROM (EEPROM), register of a computing unit, a hard drive, a removable storage unit, an optical storage system, or any suitable medium, which can be accessed by a computer or by other IT devices and applications.

In other words, the present disclosure teaches various control devices to control a combustion carried out by a burner assembly depending on an ionization-current setpoint, the burner assembly comprising a flame area (2) and at least one ionization electrode (7) arranged within a flame area (2) of the burner assembly and an air-control element (3), which is designed to influence a supply volume of air depending on an air-control signal (11), and a fuel-control element (5), which is designed to influence a supply quantity of fuel depending on a fuel-control signal (13), wherein the control device (10) is designed to receive signals (14) from at least one ionization electrode (7) and to process them into actual values of an ionization current, wherein the control device (10) is designed to generate a first air-control signal (11) and outputted to the air-control element (3) and to generate a fuel-control signal (13) by adjusting the actual values of the ionization current to the ionization-current setpoint and outputting the signal to the fuel-control element (5), to generate a setpoint (24) increased by a specified amount from the ionization-current setpoint and to generate a changed fuel-control signal (13) by adjusting the actual values of the ionization current to the increased setpoint (24) in the case of a first air-control signal (11), to evaluate the changed fuel-control signal (13) generated based on the increased setpoint (24) for if the control device (10) adjusts under the use of the increased setpoint (24) outside of a control range for a stationary control of a combustion carried out by the burner assembly and, based on this evaluation, to determine if (or that) the control device (10) adjusts under the use of the increased setpoint (24) outside of the control range for a stationary control of the combustion carried out by the burner assembly, wherein the control device (10) adjusts under the use of the increased setpoint (24) outside of the control range for a stationary control of the combustion carried out by the burner assembly if, in the case of constant input values (such as the increased setpoint (24) and/or the air-control signal (11)) and after the transient responses subside, temporal changes, in particular temporal changes outside of a specified range stored within the control device (10) of the changed fuel-control signal (13) generated by the control device (10) occur.

In some embodiments, the control device (10) is designed to generate a fuel-control signal (13) by adjusting the actual values of the ionization current to the increased setpoint, wherein the adjustment comprises a comparison of the actual values of the ionization current with the increased setpoint, the generation of an error signal from the comparison and the generation of a fuel-control signal (13) from the error signal. The changed fuel-control signal (13) generated is also output to the fuel-control element (5). The air-control element (3) is designed to influence a supply volume of air to the flame area (2) depending on an air-control signal (11). The fuel-control element (5) is designed to influence an air-supply quantity of fuel to the flame area (2) depending on a fuel-control signal (13). The increased setpoint (24) may be an increased ionization-current setpoint (24). The specified value is stored in (a storage of) the control device. The first air-control signal (11) is constant over time. The first air-control signal (11) is uninfluenced by the adjustment to the increased setpoint (24). In some embodiments, the air-control element (3) is designed to influence the supply volume of air depending on the air-control signals (11) and to report and air-control signal (12) to the control device (10). The transient responses subside within 5 seconds at the most, 15 seconds at the most, 60 seconds at the most or 5 minutes at the most. The transient response is subsided if the oscillating component of the amplitude of the output values, in particular, of the fuel-control signal (13) has reduced to the $1/e^{th}$ fraction, $e \approx 2{,}7173$, or has reduced to an even lesser percent such as a small 10% or even 1%.

The person skilled in the art recognizes that adjusting to an increased setpoint (24) is also possible when adjusting the air supply (11), wherein the fuel supply remains constant. Then, based on the air-control signal (11), it is determined by means of evaluation if the regulation adjusts within a range for a stationary control of the combustion carried out by the burner assembly.

In some embodiments, the control device (10) may generate a changed fuel-control signal (13) in the case of the first air-control signal (11) by adjusting the actual values of the ionization current to the increased setpoint (24), wherein the adjustment comprises a comparison of the actual values of the ionization current with the increased setpoint (24), the generation of an error signal from the comparison and the generation of a changed fuel-control signal (13) from the error signal.

In some embodiments, the specified amount is at least 5 percent, at least 20 percent or even at least 100 percent of the ionization-current setpoint.

The present disclosure furthermore teaches one of the aforementioned control devices, wherein the control device (10) is designed to evaluate the air-control signal (11) and/or the actual values of the ionization current (14) and to check if a stationary status is present, wherein a stationary status is present if the air-control signal (11) and/or the actual values of the ionization current (14) fluctuate within respectively specified ranges.

The present disclosure furthermore teaches one of the aforementioned control devices, wherein the air-control element (3) is designed to influence the supply volumes of air depending on the air-control signals (11) and to report and air-volume signal (12) to the control device (10), and wherein the control device (10) is designed to evaluate the air-control signal (11) and/or the reported air volume signal (12) and/or the actual values of the ionization current (14), and to check if a stationary status is present, wherein a stationary status is present if the air-control signal (11) and/or the reported air volume signal (12) and/or the actual values of the ionization current (14) fluctuate within respectively specified ranges.

The air-control signals (11) and the actual values of the ionization current preferably fluctuate within respectively specified ranges by deviations of ±1 percent at the highest, of ±10 percent at the highest or even ±50 percent at the highest around the respective average values. Arithmetical or geometrical values are taken into consideration as average values for example. Furthermore, it can have to do with adaptively formed average values. In accordance with a special embodiment, the control device (10) comprises an (adaptive) low pass, which carries out the formation of average values. The average values are, for example averaged over at least 2 seconds, at least 10 seconds or at least 20 seconds. Among other things, the distances of the respective maximum and minimum values of the average value are provided as a measurement for the deviations. Furthermore, the standard deviation of the average value and its multiple as well as the variance are taken into consideration as deviations.

In some embodiments, the generated air-control signals (11) and/or speed signals (12) are compared with each other at regular intervals. A stationary status is also predominant here if the last generated air-control signal (11) and/or speed signal (12) deviates by less than 1 percent, by less than 10 percent, or further by less than 50 percent from the air-control signal (11) and/or speed signal (12) previously taken into consideration. Typical regular intervals for the comparison of the air-control signals (11) and/or speed signals (12) include at least 2 seconds, at least 10 seconds or at least 20 seconds.

The processing of the signals (14) of the at least one ionization electrode (7) to actual values of the ionization current may comprise a processing within an analog-digital converter. In some embodiments, the control device (10) comprises the analog-digital converter. The person skilled in the art selects an analog-digital converter with a suitable resolution and speed.

The present disclosure furthermore teaches one of the aforementioned control devices, wherein the control device (10) is designed to generate a stationary fuel-control signal (13), which makes it possible to control a combustion by the burner assembly in a stationary manner within a control range for a stationary control system, depending on a signal (14), which is processed into an actual value of the ionization current, of the at least one ionization electrode (7) and depending on the ionization-current setpoint, and to output the fuel-control signal (13) generated in this manner to the fuel-control element (5).

The present disclosure furthermore teaches one of the aforementioned control devices, wherein the control device (10) is designed to determine, based on the evaluation, that the control device (10) adjusts under the use of the increased setpoint (24) outside of the control range for a stationary control of the combustion carried out by the burner assembly if the fuel-control signal (13) generated based on the increased setpoint (24) exceeds a specified maximum value.

The present disclosure furthermore teaches one of the aforementioned control devices, wherein the control device (10) is designed to determine, based on the evaluation, that the control device (10) adjusts under the use of the increased setpoint (24) outside of the control range for a stationary control of the combustion carried out by the burner assembly if the fuel-control signal (13) generated based on the increased setpoint (24) exceeds a specified maximum value during a specified time duration. The specified maximum value may be stored within the control device (10) as a value (adapted to the burner assembly). The specified maximum time duration is preferably stored within the control device (10) as a value (adapted to the burner assembly). The specified time duration is less than 1 second, less than 10 seconds or less than 60 seconds in accordance with a special embodiment.

The present disclosure furthermore teaches one of the aforementioned control devices, wherein the specified maximum value corresponds to a maximum open setting of the fuel-control element (5). The maximum open setting of the fuel-control element (5) may be stored (as a value) within (in memory) within the control device. Thereby, the fuel-control element (5) can be adjusted and/or, in the maximum open setting of the fuel-control element (5) the flow rate (6) of fuel cannot be increased by adjusting the fuel-control element (5).

The present disclosure furthermore teaches one of the aforementioned control devices, wherein the control device (10) is designed to generate a stationary fuel-control signal (13), which makes it possible to control a combustion by the burner assembly in a stationary manner within a control range for a stationary control system, depending on a signal (14), which is processed into an actual value of the ionization current, of the at least one ionization electrode (7) and depending on the ionization-current setpoint, and to save the stationary fuel-control signal (13) generated in this manner, wherein the control device (10) is designed to form a difference from the fuel-control signal (13) generated based on the increased setpoint and the stored stationary fuel-control signal (13).

The present disclosure furthermore teaches one of the aforementioned control devices, wherein the control device (10) is designed to determine, by evaluating the fuel-control signal (13) generated based on the increased setpoint, that the control device (10) adjusts under the use of the increased setpoint (24) outside of a control range for a stationary control of a combustion carried out by the burner assembly if the formed difference exceeds a specified threshold.

The present disclosure furthermore teaches one of the aforementioned control devices, wherein the control device (10) is designed to generate a value as a function of a difference, which is been formed from the fuel-control signal (13) generated based on the increased setpoint and the stored stationary fuel-control signal (13), wherein the control device (10) is designed to determine, by evaluating the fuel-control signal (13) generated based on the increased setpoint, that the control device (10) adjusts under the use of the increased setpoint (24) outside of a control range for a stationary control of a combustion carried out by the burner assembly if the value generated as a function of the difference exceeds a specified threshold.

The present disclosure furthermore teaches one of the aforementioned control devices, wherein the control device (10) is designed to generate a stationary fuel-control signal (13), which makes it possible to control a combustion by the burner assembly in a stationary manner within a control range for a stationary control system, depending on a signal (14), which is processed into an actual value of the ionization current, of the at least one ionization electrode (7) and depending on the ionization-current setpoint, and to save the fuel-control signal (13) generated in this manner, wherein the control device (10) is designed to form an amount of a difference from the fuel-control signal (13) generated based on the increased setpoint (24) and the stored stationary fuel-control signal (13), and based on this evaluation, to determine that the control device (10) adjusts under the use of the increased setpoint (24) outside of the control range for a stationary control of the combustion carried out by the burner assembly, if the formed amount exceeds a specified threshold over an entire specified time span (constantly and/or continuously). The entire specified time span may be less than 1 second, less than 10 seconds or less than 60 seconds, in some embodiments.

In some embodiments, the aforementioned function is the identity function or the amount function. In some embodiments, the function is a temporal derivation. In some embodiments, the function is a quotient from the difference and time or a quotient from the amount of the difference and time. For example, the time span between two actual values of the ionization current processed immediately after one another comes under consideration as time. Furthermore, for example, the time span between two received signals (14) of the ionization electrode (7) come under consideration as time.

The present disclosure furthermore teaches one of the aforementioned control devices, wherein the control device (10) is designed to generate a stationary fuel-control signal (13), which makes it possible to control a combustion by the burner assembly in a stationary manner within a control range for a stationary control system, depending on a signal (14), which is processed into an actual value of the ionization current, of the at least one ionization electrode (7) and depending on the ionization-current setpoint, and to save the fuel-control signal (13) generated in this manner, wherein the control device (10) is designed to form an amount of a difference from the fuel-control signal (13) generated based on the increased setpoint (24) and the stored stationary fuel-control signal (13), and based on this evaluation, to determine that the control device (10) adjusts under the use of the increased setpoint (24) outside of the control range for a stationary control of the combustion carried out by the burner assembly, if the formed amount continues to exceed a specified threshold after a specified time span expires.

The present disclosure furthermore teaches one of the aforementioned control devices, wherein the control device (10) has a communication interface to send error messages and is designed to generate an error message if, based on the evaluation, it is determined that the control device (10) adjusts under the use of the increased setpoint (24) outside of a control range for a stationary control of a combustion carried out by the burner assembly, wherein the control device (10) is designed to send the generated error message based on the communication interface.

In some embodiments, the communication interface is a wireless interface and/or an interface of a CAN bus according to ISO 11898-1:2015. The interface is preferably compatible with the protocol, preferably a protocol of a CAN bus according to ISO 11898-1:2015. The error message may be sent under the use of the protocol. Sending the error message based on the communication interface occurs, for example, to a user interface, such as a graphic user interface. Sending the error message based on the communication interface can furthermore take place, for example to another unit, such as another control device (10) and/or a mobile terminal unit.

The present disclosure furthermore teaches one of the aforementioned control devices, wherein the control device (10) is designed to output a shutoff fuel-control signal (13) to reduce the supply quantity of fuel and output this to the fuel-control element (5) if, based on the evaluation, it is determined that the control device (10) adjusts under the use of the increased setpoint (24) outside of a control range for a stationary control of a combustion carried out by the burner assembly.

In some embodiments, fuel-control element (5) can be locked. Outputting the shutoff fuel-control signal (13) to the fuel-control element (5) causes a locking of the fuel-control element (5). In the locked stat, no fuel (6) can flow through the fuel-control element (5). The burner assembly is in a safe state without combustion during the locking.

In some embodiments, the burner assembly and/or the fuel-control element (5) can go into a lockout position. The aforementioned outputting of the shutoff fuel-control signal (13) is sent to the burner assembly, in particular, to the fuel-control element (5). It causes a lockout position of the burner assembly and/or of the fuel-control element (5). In lockout position, the fuel-control element (5) is permanently locked. The lockout position and therefore the permanent locking can (only) be lifted via a manual intervention, in particular, a manual input.

The present disclosure furthermore teaches one of the aforementioned control devices, wherein the control device is designed to generate an air-control signal (11), to save it and to output it to the air-control element (3), wherein the control device (10) is designed to generate a setpoint increased by a specified amount from the ionization-current setpoint and to generate a fuel-control signal (13) by adjusting to the increased setpoint and to output it to the fuel-control element (5) and at the same time or primarily at the same time, to output the stored air-control signal (11) to the air-control element (3).

In some embodiments, "at the same time" means within less than 2 seconds, within less than 0.2 seconds, or within less than 0.05 seconds.

In some embodiments, the generated and saved air-control signal (11) makes a stationary control of the combustion carried out by the burner assembly possible.

The present disclosure furthermore teaches one of the aforementioned control devices, wherein the control device (10) is designed to generate another set point (24) subsequent to the evaluation, to generate another changed fuel-control signal (13) by adjusting the actual values of the ionization current to the other setpoint (24), which makes it possible within a control range for a stationary control to regulate a combustion carried out by a burner assembly in a stationary manner, and to output the other fuel-control signal (13) to the fuel-control element (5).

The present disclosure furthermore teaches one of the aforementioned control devices, wherein the control device (10) has a settable register value to instigate a test for the stationary control under the use of the increased setpoint (24) and is designed to generate pairs from every single air-control signal (11) and every single fuel-control signal (13), wherein the control device (10) is designed to calculate, from each of the generated pairs, a characteristic curve value (19) made up of the fuel-control signal (13) and the air-control signal (11) so that there is a calculated characteristic curve value (19) for each generated pair, wherein the control device (10) is designed to average the calculated characteristic curve values (19) based on a first specified time constant to a first average value, wherein the control device (10) is designed to average the calculated characteristic curve values (19) based on a second specified time constant to a second average value, wherein the control device (10) is designed to calculated difference from the first average value in the second average value and compare the calculated difference with a specified threshold, and to set the register value to instigate a test for stationary control under the use of an increased setpoint (24) if the calculated difference exceeds the specified threshold.

In some embodiments, the control device (10) is designed to calculate, from each of the generated pairs, a characteristic curve value (19) as a function of the fuel-control signal (13), from stored characteristic curve values (17, 18) and the air-control signal (11) so that there is a calculated characteristic curve value (19) for each generated pair.

In some embodiments, the control device (10) is designed to calculate, from each of the generated pairs, a characteristic curve value (19) as a quotient of the difference of fuel-control signal (13), and a value of a characteristic curve (17) or (18) determined with the aid of the air-control signal (11) and of the difference of the values of both characteristic curves (17) and (18) determined with the aid of the air-control signal (11) so that there is a calculated characteristic curve value (19) for each generated pair.

In some embodiments, the control device comprises one or a plurality of low pass filters to carry out the averaging to the first and/or the second average value.

In some embodiments, the first and/or the second average value are geometrical and/or arithmetical average values.

In some embodiments, the threshold for a (normalized) difference of both average values is 5 percent, 20 percent or even 100 percent. Preferably, the threshold is stored (as a valued adapted to the burner assembly) within the control device (10).

In some embodiments, the first time constant is 10, 15 or 20 seconds. In some embodiments, the second time constant is different from the first time constants and 30, 45 or 60 seconds.

In some embodiments, the air-control element (3) is designed to influence a supply quantity of air depending on an air-control signal (11) by setting a speed (12) within a speed range, wherein the control device (10) is designed to break down the settable speed range into at least two speed ranges (32), to select one of the at least two speed ranges (32), within the selected speed range (32), to generate a second air-control signal (11), to generate a setpoint (24) increased by a specified amount from the ionization-current setpoint, to generate a changed fuel-control signal (13) by adjusting the actual values of the ionization current to the increased setpoint (24) in the case of a second air-control signal (11), to evaluate the changed fuel-control signal (13) generated based on the increased setpoint (24) for if the control device (10) adjusts under the use of the increased setpoint (24) outside of a control range for a stationary control of a combustion carried out by the burner assembly, wherein the control device (10) has settable register values for each of the at least two speed ranges (32) and is designed to set the register value for the selected speed range (32) based on the evaluation for stationary control of a combustion carried out by the burner assembly.

The second air-control signal (11) may be constant over time. The second air-control signal (11) may be uninfluenced by the adjustment to the increased setpoint (24). In some embodiments, the second air-control signal (11) is identical to the first air-control signal (11). In other words, on the one hand, it is possible to carry out the tests within a first speed range (32) for a first air-control signal (11) and then, to repeat it in a second speed range (32) for a second air-control signal (11). On the other hand, it is possible to carry out the test in a first speed range (32) for a first air-control signal (11) and to set the register value for the speed range (32) for a first air-control signal (11).

In some embodiments, the control device (10) breaks down the settable range of the speed (12) into individual speed ranges (32) and wherein a test for a stationary control with an increased ionization-current setpoint at a speed within a speed range (32) provide a representative results for all other speeds (12) with reference to if the current air-ratio increment during operation λ (20) is within or outside of a λ range (26).

In some embodiments, the control device (10) is designed to prevent readjustment of the actual values of the ionization current to the increased setpoint (24) in the case of air-control signals (11) within a speed range (32), for which the settable register value is set. In some embodiments, the λ range (26) is defined by means of increased or critical emissions occurring in the case of operation within the λ range (26).

In some embodiments, the register values, which can be set for each of the at least two speed ranges (32), can be deleted and the control device (10) is designed to delete all of the registered values, which can be set for each of the at least two speed ranges (32).

In some embodiments, the speed range of the speed (12) broken down into markable speed ranges (32), wherein the control device is designed to lift and/or reverse the markings for each speed range (32) after a specified time span and/or reset them. The control device is designed to carry out a test for stationary behavior under an increased ionization-current setpoint due to the lifted and/or reversed and/or reset markings for each speed range (32) within each speed range (32) with a lifted and/or reversed and/or reset marking. Typical values of the specified time span are 10 hours or 30 hours or 100 hours.

In some embodiments, the speed range of the speed (12) broken down into markable speed ranges (32), wherein the control device is designed to effectively carry out other monitoring and/or correction mechanisms, wherein the control device is designed to carry out a test for stationary behavior under an increased ionization-current setpoint if a specified temporal threshold stored within the control device (10) has been exceeded since the effective execution of other monitoring and/or correction mechanisms, and to prevent a test for stationary behavior under an increased ionization-current setpoint if the other monitoring and/or correction mechanisms could be effectively carried out.

In some embodiments, a burner assembly comprises a flame area (2) and at least one ionization electrode (7) arranged within the flame area (2) of the burner assembly and an air-control element (3), which influences a supply volume of air depending on an air-control signal (11), and a fuel-control element (5), which influences a supply quantity of fuel depending on a fuel-control signal (13), the burner assembly additionally comprising one of the aforementioned control devices (10), wherein the control device (10) is communicatively (11-14) connected with the at least one ionization electrode (7), the air-control element (3) and the fuel-control element (5).

In some embodiments, a control device controls a combustion carried out by a burner assembly depending on an ionization-current setpoint, the burner assembly comprising a flame area (2) and at least one ionization electrode (7) arranged within the flame area (2) of the burner assembly and an air-control element (3), which is designed to influence a supply volume of air depending on an air-control signal (11), and a fuel-control element (5), which is designed to influence a supply quantity of fuel depending on a fuel-control signal (13), wherein the control device (10) is designed to receive signals (14) from at least one ionization electrode (7) and to process actual values of an ionization current, wherein the control device (10) is designed to generate a first air-control signal (11) and outputted to the air-control element (3) and to generate a fuel-control signal (13) by adjusting the actual values of the ionization current to the ionization-current setpoint and outputting the signal to the fuel-control element (5), and to generate a setpoint (24) increased by a specified amount from the ionization-current setpoint and to generate a changed fuel-control signal (13) by adjusting the actual values of the ionization current to the increased setpoint (24) in the case of a first air-control signal (11), and to evaluate the changed fuel-control signal (13) generated based on the increased setpoint (24) by comparing it with a specified maximum value and based on the evaluation, to detect a blockage, wherein the control device (10) is designed to detect the blockage based on the evaluation if the fuel-control signal (13) generated using the increased setpoint (24) exceeds the specified maximum value.

In some embodiments, the control device (10) is designed to evaluate the air-control signal (11) and/or the actual values of the ionization current (14) and to check for the absence of a blockage, wherein the blockage is absent if the air-control signal (11) and/or the actual values of the ionization current (14) fluctuate within respectively specified ranges.

In some embodiments, the burner assembly comprises an exhaust-gas tract, e.g. an exhaust-gas tract in (direct) fluidic connection with the flame area (2) of the burner assembly, and the blockage is a blockage of the exhaust-gas tract.

In some embodiments, the control device (10) is designed to detect the blockage based on the evaluation if the fuel-control signal (13) generated using the increased setpoint (24) exceeds the specified maximum value during a specified time duration. In some embodiments, the specified maximum value corresponds to a maximum open setting of the fuel-control element (5).

In some embodiments, the control device (10) is designed to generate a stationary fuel-control signal (13), which makes it possible to control a combustion by the burner assembly in a stable, meaning a stationary manner within a control range for a stationary control system, depending on a signal (14), which is processed into an actual value of the ionization current, of the at least one ionization electrode (7) and depending on the ionization-current setpoint, and to save the stationary fuel-control signal (13) generated in this manner, wherein the control device (10) is designed to form a difference from the fuel-control signal (13) generated based on the increased setpoint (24) and the stored stationary fuel-control signal (13), and wherein the control device (10) is designed to detect the blockage based on the evaluation of the fuel-control signal (13) generated by the increased setpoint (24) if the form difference or a value generated as a function of the form difference exceeds a specified threshold.

In some embodiments, the control device (10) is designed to generate a stationary fuel-control signal (13), which makes it possible to control a combustion by the burner assembly in a stable, meaning a stationary manner within a control range for a stationary control system, depending on a signal (14), which is processed into an actual value of the ionization current, of the at least one ionization electrode (7) and depending on the ionization-current setpoint, and to save the stationary fuel-control signal (13) generated in this manner, wherein the control device (10) is designed to form an amount of a difference from the fuel-control signal (13) generated based on the increased setpoint (24) and the stored stationary fuel-control signal (13), and wherein the control device (10) is designed to detect the blockage based on the evaluation of the fuel-control signal (13) generated by the increased setpoint (24) if the formed amount exceeds a specified threshold over an entire specified time span.

In some embodiments, the control device (10) has a communication interface to send error messages and is designed to generate an error message if, based on the evaluation, the blockage is detected, wherein the control device (10) is designed to send the generated error message based on the communication interface.

In some embodiments, the control device (10) is designed to generate a shutoff fuel-control signal (13) to reduce the supply quantity of fuel to zero and output this to the fuel-control element (5) if, based on the evaluation, the blockage is detected.

In some embodiments, the control device (10) is designed to generate another set point (24) subsequent to the evaluation, to generate another changed fuel-control signal (13) by adjusting the actual values of the ionization current to the other setpoint (24), which makes it possible within a control range for a stationary control to regulate a combustion carried out by a burner assembly in a stable manner, and to output the other fuel-control signal (13) to the fuel-control element (5).

In some embodiments, the control device (10) as a settable register value to instigate a test for the presence of the blockage under the use of the increased setpoint (24) and is designed to generate pairs from every single air-control signal (11) and every single fuel-control signal (13), wherein the control device (10) is designed to calculate, from each of the generated pairs, a characteristic curve value (19) made up of the fuel-control signal (13) and the air-control signal (11) so that there is a calculated characteristic curve value (19) for each generated pair, wherein the control device (10) is designed to average the calculated characteristic curve values (19) based on a first specified time constant to a first average value, wherein the control device (10) is designed to average the calculated characteristic curve values (19) based on a second specified time constant to a second average value, wherein the control device (10) is designed to calculate a difference from the first average value and the second average value and compare the calculated difference with a specified threshold, and to set the register value to instigate a test for the presence of the blockage under the use of an increased setpoint (24) if the calculated difference exceeds the specified threshold.

In some embodiments, the air-control element (3) is designed to influence a supply quantity of air depending on an air-control signal (11) by setting a speed (12) within a speed range, wherein the control device (10) is designed to break down the settable speed range into at least two speed ranges (32), to select one of the at least two speed ranges (32), within the selected speed range (32), to generate a second air-control signal (11), to generate a setpoint (24) increased by a specified amount from the ionization-current setpoint, to generate a changed fuel-control signal (13) by adjusting the actual values of the ionization current to the increased setpoint (24) in the case of a second air-control signal (11), to evaluate the changed fuel-control signal (13) generated based on the increased setpoint (24) and to detect the blockage based on the evaluation, wherein the control device (10) has settable register values for each of the at least two speed ranges (32) and is designed to set the register value for the selected speed range (32) based on the detected blockage.

In some embodiments, the control device (10) is designed to prevent readjustment of the actual values of the ionization current to the increased setpoint (24) in the case of air-control signals (11) within a speed range (32), for which the settable register value is set.

In some embodiments, the register values, which can be set for each of the at least two speed ranges (32), can be deleted and the control device (10) is designed to delete all of the registered values, which can be set for each of the at least two speed ranges (32).

In some embodiments, a burner assembly comprises a flame area (2) and at least one ionization electrode (7) arranged within a flame area (2) of the burner assembly and an air-control element (3), which influences a supply volume of air depending on an air-control signal (11), and a fuel-control element (5), which influences a supply quantity of fuel depending on a fuel-control signal (13), the burner assembly additionally comprising one of the aforementioned control devices (10), wherein the control device (10) is communicatively (11-14) connected with the at least one ionization electrode (7), the air-control element (3) and the fuel-control element (5).

That which has been stated refers to individual embodiment of the disclosure. Various changes to the embodiments can be performed without deviating from the basic idea and without leaving the scope of the disclosure. The object of the present disclosure is defined via its claims. Various changes can be performed without leaving the scope of protection of the following claims.

REFERENCE NUMBERS

1 burner
2 combustion chamber
3 fans
4 air flow rate
5 fuel valve
6 fluid flow of flammable fluids (fuel flow rate)
7 ionization electrode
8 exhaust-gas tract
9 cooled exhaust gas
10 adjustment, control and/or monitoring unit
11 air flow-rate signal from 10
12 speed signal (of the fan 3)
13 fuel flow-rate signal from 10
14 signal from ionization electrode 7
15 ionization-current setpoint
16 ionization-current setpoint/speed signal characteristic curve
17 low-calorific fuel flow rate/speed signal characteristic curve
18 higher-calorific fuel flow rate/speed signal characteristic curve
19 currently applicable fuel flow rate/speed signal characteristic curve
20 air-ratio increment λ
21 ionization-current setpoint characteristic curve/air-ratio increment
22 ionization-current setpoint for a given speed signal
23 air-ratio increment for actual ionization-current setpoint
24 actual ionization-current setpoint increased at a constant speed
25 air-ratio increment at the increased ionization-current setpoint
26 critical range of the air-ratio increment
27 ionization-current setpoint/air-ratio increment characteristic curve in the case of partial covering/blockage
28 air-ratio increment for actual ionization-current setpoint in the case of partial covering/blockage
29 air-ratio increment at the increased ionization-current setpoint in the case of partial covering/blockage
30 ionization-current setpoint/air-ratio increment characteristic curve in the case of covering/blockage at an advanced stage
31 air-ratio increment for actual ionization-current setpoint in the case of advanced-stage covering/blockage
32 ranges or individual range (of the speed 12), into which the speed range is broken down

The invention claimed is:

1. A control device for a combustion carried out by a burner assembly depending on an ionization-current setpoint, the burner assembly comprising a flame area, an ionization electrode within the flame area, an air-control element to influence a supply volume of air depending on an air-control signal, and a fuel-control element to influence a supply quantity of fuel depending on a fuel-control signal;

the control device receiving a signal from the ionization electrode and processing the signal into a corresponding actual value of an ionization current;

the control device generating:

a first air-control signal transmitted to the air-control element;

a fuel-control signal by adjusting the ionization current to the ionization-current setpoint based on the corresponding actual value of the ionization current measured by the ionization electrode and transmitting the signal to the fuel-control element;

a setpoint increased by a specified amount from the ionization-current setpoint;

a changed fuel-control signal by adjusting the ionization current to the increased setpoint; and the control device evaluating the changed fuel-control signal generated based on the increased setpoint by comparing it with a specified maximum value and based on the evaluation, identifying a blockage;

wherein the control device recognizes the blockage if the fuel-control signal generated using the increased setpoint exceeds the specified maximum value; and wherein the burner assembly comprises an exhaust-gas tract in fluidic connection with the flame area of the burner assembly, and the blockage comprises a blockage of the exhaust-gas tract.

2. The control device as claimed in claim 1, wherein the control device evaluates the air-control signal or the actual value of the ionization current and checks for the absence of a blockage, wherein the blockage is absent if the air-control signal or the actual values of the ionization current fluctuate within respectively specified ranges.

3. The control device as claimed in claim 1, wherein the control device detects the blockage based on the evaluation if the fuel-control signal generated using the increased setpoint exceeds the specified maximum value during a specified time duration.

4. The control device as claimed in claim 3, wherein the specified maximum value corresponds to a maximum open setting of the fuel-control element.

5. The control device as claimed in claim 1, wherein:

the control device generates a stationary fuel-control signal to control combustion by the burner assembly in a stable manner within a control range for a stationary control system, depending on the actual value of the ionization current and the ionization-current setpoint and saves the stationary fuel-control signal generated in this manner;

wherein the control device forms a difference from the fuel-control signal generated based on the increased setpoint and the stored stationary fuel-control signal; and wherein the control device detects the blockage based on the evaluation of the fuel-control signal generated by the increased setpoint if the formed difference or a value generated as a function of the form difference exceeds a specified threshold.

6. The control device as claimed in claim 1, wherein:

the control device generates a stationary fuel-control signal to control a combustion by the burner assembly in a stable manner within a control range for a stationary control system, depending on the actual value of the ionization current the ionization-current setpoint, and to save the stationary fuel-control signal generated in this manner;

wherein the control device forms an amount of a difference from the fuel-control signal generated based on the increased setpoint and the stored stationary fuel-control signal; and wherein the control device detects the blockage based on the evaluation of the fuel-control signal generated by the increased setpoint if the formed amount exceeds a specified threshold over an entire specified time span.

7. The control device as claimed in claim 1, wherein:

the control device includes a communication interface to send error messages and is designed to generate an error message if, based on the evaluation, the blockage is detected; and the control device sends the generated error message via the communication interface.

8. The control device as claimed in claim 1, wherein the control device generates a shutoff fuel-control signal to reduce the supply quantity of fuel to zero if, based on the evaluation, the blockage is detected.

9. The control device as claimed in claim 1, wherein the control device:

generates another set point subsequent to the evaluation; and generates another changed fuel-control signal by adjusting the ionization current to the other setpoint; and transmits the other fuel-control signal to the fuel-control element.

10. The control device as claimed in claim 1, wherein the control device has a settable register value to instigate a test for the presence of the blockage under the use of the increased setpoint and generates pairs from every single air-control signal and every single fuel-control signal;

wherein the control device calculates a characteristic curve plotting the fuel-control signal versus the air-control signal so that there is a calculated characteristic curve value for each generated pair;

wherein the control device averages the calculated characteristic curve values based on a first specified time constant to a first average value;

wherein the control device averages the calculated characteristic curve values based on a second specified time constant to a second average value;

wherein the control device calculates a difference from the first average value and the second average value and compare the calculated difference with a specified threshold; and to set the register value to instigate a test for the presence of the blockage under the use of an increased setpoint if the calculated difference exceeds the specified threshold.

11. The control device as claimed in claim 1, wherein the air-control element influences a supply quantity of air depending on an air-control signal by setting a speed within a speed range;

wherein the control device breaks down the settable speed range into at least two speed ranges;

selects one of the at least two speed ranges;

within the selected speed range, generates a second air-control signal;

generates a setpoint increased by a specified amount from the ionization-current setpoint;

generates a changed fuel-control signal by adjusting the ionization current to the increased setpoint;

evaluates the changed fuel-control signal generated based on the increased setpoint; and detects the blockage based on the evaluation;

wherein the control device has settable register values for each of the at least two speed ranges and sets the register value for the selected speed range based on the detected blockage.

12. The control device as claimed in claim 11, wherein the control device prevents readjustment of the ionization current to the increased setpoint for which the settable register value is set.

13. The control device as claimed in claim 11, wherein the register values, which can be set for each of the at least two speed ranges, can be deleted and the control device deletes all of the registered values, which can be set for each of the at least two speed ranges.

14. A burner assembly comprising:

a flame area;

an ionization electrode arranged within the flame area;

an air-control element which influences a supply volume of air depending on an air-control signal;

a fuel-control element which influences a supply quantity of fuel depending on a fuel-control signal; and a control device receiving a signal from the ionization electrode and processing the signals into a corresponding actual value of an ionization current;

the control device generating:

a first air-control signal transmitted to the air-control element;

a fuel-control signal by adjusting the ionization current to the ionization-current setpoint and transmitting the signal to the fuel-control element;

a setpoint increased by a specified amount from the ionization-current setpoint;

a changed fuel-control signal by adjusting the ionization current to the increased setpoint in the case of a first air-control signal; and the control device evaluating the changed fuel-control signal generated based on the increased setpoint by comparing it with a specified maximum value and based on the evaluation, to detect a blockage;

wherein the control device recognizing the blockage based on the evaluation if the fuel-control signal generated using the increased setpoint exceeds the specified maximum value;

wherein the control device is communicatively connected with the at least one ionization electrode, the air-control element, and the fuel-control element; and an exhaust-gas tract in fluidic connection with the flame area of the burner assembly;

wherein the blockage comprises a blockage of the exhaust-gas tract.

* * * * *